US005199135A

United States Patent [19]

Gold

[11] Patent Number: 5,199,135

[45] Date of Patent: Apr. 6, 1993

[54] BINDING DEVICE

[76] Inventor: Peter Gold, 389 Peninsula Blvd., Hempstead, N.Y. 11550

[21] Appl. No.: 904,256

[22] Filed: Jun. 25, 1992

[51] Int. Cl.[5] ..... B65D 63/00

[52] U.S. Cl. ..... 24/16 R; 24/17 AP; 24/300

[58] Field of Search ..... 24/16 R, 17 AP, 17 B, 24/30.5 R, 30.5 P, 129 B, 300, 301, 302; 248/74.3

[56] References Cited

U.S. PATENT DOCUMENTS

| | | | |
|---|---|---|---|
| 348,197 | 8/1886 | Emerick | 24/16 R |
| 357,877 | 2/1887 | Taylor | 24/16 R |
| 1,338,875 | 5/1920 | Simao | 24/16 R |
| 2,793,904 | 5/1957 | Gale | 24/16 R |
| 3,358,338 | 12/1967 | Clasen | 24/129 R |
| 4,158,250 | 6/1979 | Ringwald | 24/16 R |
| 4,270,247 | 6/1981 | Freedom | 24/30.5 P |
| 4,335,490 | 6/1982 | Teachout | 24/16 R |
| 4,524,937 | 6/1985 | Zizan | 248/74.3 |
| 4,569,108 | 2/1986 | Schwab | 24/17 AP |
| 5,000,747 | 3/1991 | Cardo et al. | 24/30.5 R |

FOREIGN PATENT DOCUMENTS

| | | | |
|---|---|---|---|
| 0301486 | 10/1917 | Fed. Rep. of Germany | 24/30.5 R |
| 0674729 | 4/1939 | Fed. Rep. of Germany | 24/30.5 R |
| 0388123 | 2/1933 | United Kingdom | 24/16 R |

*Primary Examiner*—Victor N. Sakran

[57] ABSTRACT

An elastic binding device for circumferentially containing a bundle. A closed-loop elastic band is stretched around a bundle and an end portion thereof is projected through itself and seated in a notch of a dowel pin holding the projected end.

1 Claim, 1 Drawing Sheet 12
30
20
14

32
30
34

20
3
22
22
3

22
20

A
32
12
30
34
22
20
B
32
12
34
20
22
30
C
34
12
32
20
24
22
30
D
20
12
30

34
34
20
30
14

20
8
14

20
34
22
30
14
32

34
20
12
30
14

20
12
34
30
14

BINDING DEVICE

The present invention relates generally to a bundle-encircling elastic binding device of a type secured in place with a dowel pin and, more particularly, to improvements in the dowel pin to obviate inadvertent loss of its bundle-securing function.

EXAMPLE OF THE PRIOR ART

It is already well known by the description and drawing illustrations of U.S. Pat. No. 4,158,250 issued on Jun. 19, 1979 to Ringwald to provide a binding device of a type in which a closed loop elastic band is disposed in encircling relation about a bundle and one opposite end is projected through the other opposite end and held against withdrawal therefrom by a dowel pin inserted in a directional path (i.e. along the lengthwise axis of the dowel pin) through the projected opposite end, whereby the dowel pin so positioned and used is effective to secure the binding device in place.

In use, however, the dowel pin is often inadvertently pushed or otherwise urged through additional directional movement, with the consequence that it releases the projected or engaged end of the elastic and the bundle is no longer held together.

Broadly, it is an object of the present invention to provide an improved binding device of the referenced Ringwald type, overcoming the foregoing and other shortcomings of the prior art. More particularly, it is an object to utilize to advantage the urgency of the elastic construction material of the closed loop, not just to allow encirclement of different size bundles, but also to engage the dowel pin incident to obviating the inadvertent release of the elastic binding device.

The description of the invention which follows, together with the accompanying drawings should not be construed as limiting the invention to the example shown and described, because those skilled in the art to which this invention appertains will be able to devise other forms thereof within the ambit of the appended claim.

FIGS. 5A–5D are diagramatic progressive views showing the elastic band being mounted on the pin;

Figures 1, 2, 3, 4, 5, 6, 7, 8, 9, 10:
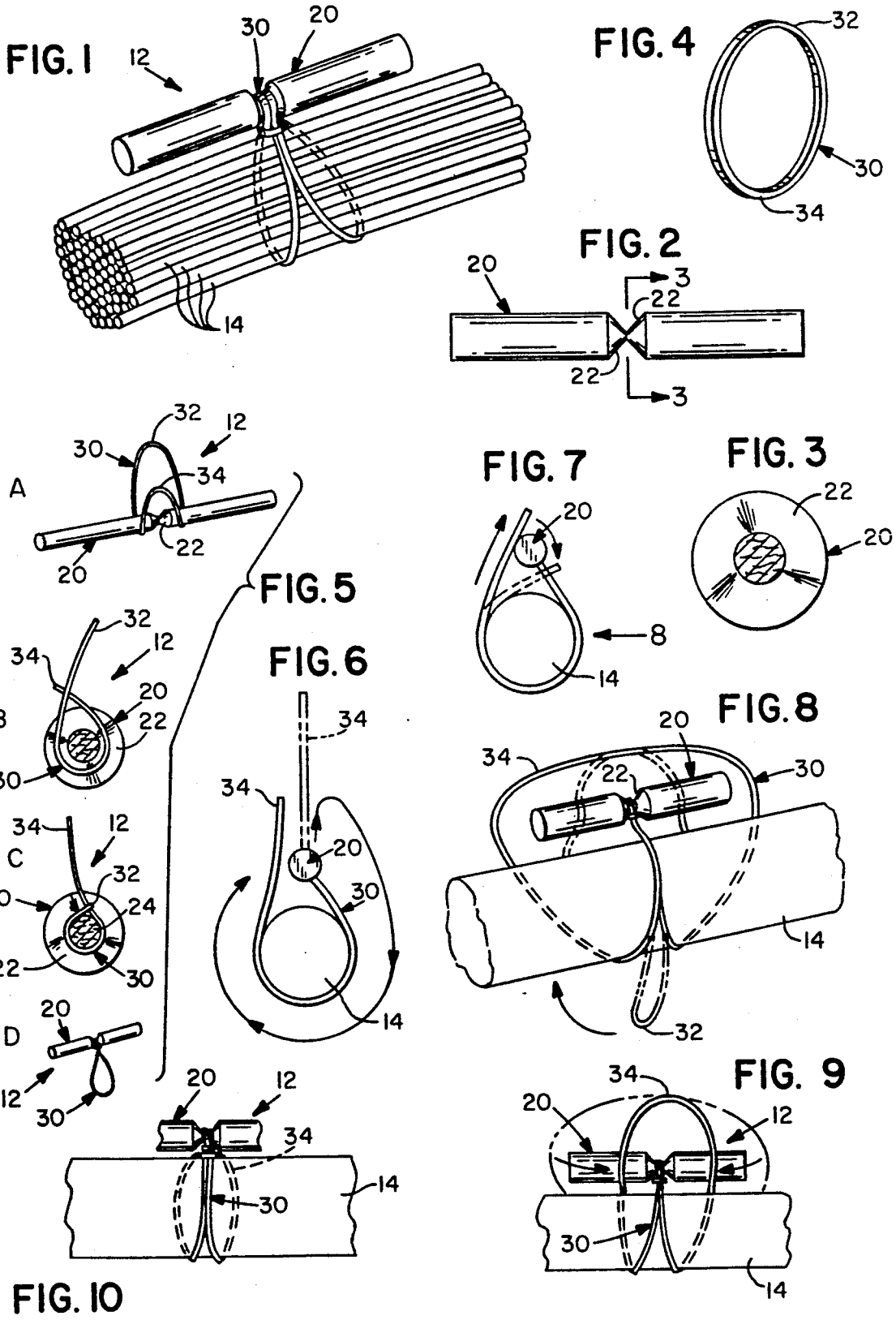
FIG. 1 is a perspective view of a binding device embodying the present invention disposed about and binding a bundle.
FIG. 2 is a front elevational view of the dowel pin of the binding device.
FIG. 3 is an enlarged sectional view taken along line 3—3 of FIG. 2.
FIG. 4 is an enlarged perspective view of the closed elastic loop of the binding device.
FIG. 6 is a diagramatic end view of the binding device showing the initial looping of the band about a bundle.
FIG. 7 is a diagramatic end view of the receipt of the band loop portion over the ends of the pin so as to contain a bundle.
FIG. 8 is a diagramatic perspective view of the binding operation taken in the direction of arrow 8 of FIG. 7.
FIG. 9 is a diagramatic view comparable to FIG. 8 but showing the next step in the binding operation.
FIG. 10 is a diagramatic view similar to FIG. 9 showing the binding device containing and binding the bundle in its final position.

Referring now in detail to the drawings, in particular FIG. 1 thereof, therein illustrated is a novel binding device embodying the present invention generally designated by reference numeral 12 which is used to circumferentially contain and bind a plurality of items such as rods 14, though it is understood that this is only for purposes of example. Binding device 12 includes a preferably wooden dowel pin 20 and an elastic of elastomeric closed band 30. As shown best in FIGS. 2 and 3, pin 20 has along its length a centrally disposed, V-shaped notch 22 in cross section, which is the crux of the present invention and is the patentable advance over the prior art, as will be better understood as the description proceeds.

As shown in FIG. 4, the closed-loop band 30 has a circular profile and is made of an elastic or elastomeric construction material such as rubber. The closed loop band is intended for disposition around the bundle as shown in FIG. 1 in stretched condition and, therefore, its unstretched length is preferably somewhat less than the circumference of the bundle. Further in this regard, it is to be understood that the attributes of the elastic construction material of the loop or band 30 are used to maximum advantage since, not only does it permit encirclement of different sized bundles 14, but it produces an urgency or contraction lengthwise of the length portions of the band, and this is used in accordance with the present invention to achieve an engagement to the dowel pin 20 which obviates its inadvertent release from its operative position. This operative dowel pin position is in relation to band 30 having a first end loop portion 32 and an opposite second end loop portion 34 as shown in greater detail in FIG. 5.

As shown in FIG. 5A, the second end loop portion 34 is extended through the first end loop portion 32 and is also looped around the dowel or pin 20. The second loop end 34 is received through the first end loop 32 as can be seen in FIG. 5B, and is then tightened or contracted so that the loop portion 32 of the band under the lengthwise contraction urgency provided by the elastic construction material of the band 30 snaps into, or seats within the notch 22 so that it assumes the final position shown in FIG. 5D. In this state, and upon release of the second end loop, the elastic band relaxes somewhat and is held against movement within the V-shaped notch of the dowel as is also, of course, the dowel pin 20 held against movement lengthwise thereof, thereby preventing any further loosening of the dowel pin 20 from its FIG. 5D operative position. As a result of this notched arrangement, it is not necessary to otherwise bind the band to the pin 20, inasmuch as the seating of the loop end 34 in the notch 22 is sufficient to keep the band permanently affixed to the pin in this arrangement.

After being so assembled, the device may then be used to bundle a plurality of articles such as shown in FIGS. 1 and FIGS. 6–10. In this case, and referring to FIGS. 6 and 8, the free end portion of the loop 34 is circumferentially looped about the intended bundle 14 and is then looped over the ends of the dowel as shown in FIGS. 7–9, as shown by the arrows. Due to the fact that it is necessary to stretch the elastic loop 30 when it is extended over the bundle 14 and the ends of the pin when it is released after being placed over the ends of the pin 20, it contracts and assumes the final position shown in FIG. 10. At this point, the bundle is securely affixed to the loop 30 and the pin 20 and is centered relative thereto as a result of the central location of the loop 30 on pin 20.

While the binding device using the notched dowel pin, herein shown and disclosed in detail, is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claim.

What is claimed is:

1. In a binding device of a type in which a closed loop elongated elastic band having opposed first and second ends is disposed in encircling relation about a bundle with said first end projected through the second end and held against withdrawal therefrom by a dowel pin inserted in a directional path through said projected first end, the improvement comprising a circular notch V-shaped in cross section at a medial location on said dowel pin, said band being wrapped about said notch of said dowel with the first end of said band being passed through said band loop whereby the second end of said band is cinched tightly about said dowel within said notch, said projected first end of said loop being subsequently seated in said notch upon bundle encirclement under the urging of said elastic whereby further movement of said dowel pin along said directional path is inhibited to correspondingly obviate inadvertent disengagement of said binding device from about said bundle.

* * * * *